US007584795B2

(12) United States Patent
Hepburn et al.

(10) Patent No.: US 7,584,795 B2
(45) Date of Patent: Sep. 8, 2009

(54) SEALED BRANCH WELLBORE TRANSITION JOINT

(75) Inventors: Neil Hepburn, Sola (NO); Frode Berge, Royneberg (NO); Karl Demong, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 204 days.

(21) Appl. No.: 11/409,724

(22) Filed: Apr. 24, 2006

(65) Prior Publication Data

US 2006/0266531 A1 Nov. 30, 2006

Related U.S. Application Data

(63) Continuation-in-part of application No. 10/767,656, filed on Jan. 29, 2004, now Pat. No. 7,213,652.

(51) Int. Cl.
*E21B 7/06* (2006.01)

(52) U.S. Cl. ..... 166/313; 166/50; 166/242.5

(58) Field of Classification Search ..... 166/277, 166/313, 50, 242.1, 242.5
See application file for complete search history.

(56) References Cited

U.S. PATENT DOCUMENTS

| | | | | |
|---|---|---|---|---|
| 5,318,122 | A | 6/1994 | Murray et al. | |
| 5,338,648 | A | 8/1994 | Kojima et al. | |
| 5,340,160 | A * | 8/1994 | Meijers et al. | 285/15 |
| 5,458,209 | A | 10/1995 | Hayes et al. | |
| 5,615,740 | A | 4/1997 | Comeau et al. | |
| 5,881,809 | A | 3/1999 | Gillespie et al. | |
| 5,938,925 | A | 8/1999 | Hamid et al. | |
| 6,070,671 | A | 6/2000 | Cumming et al. | |
| 6,089,320 | A | 7/2000 | LaGrange | |
| 6,092,602 | A | 7/2000 | Gano | |
| 6,241,021 | B1 | 6/2001 | Bowling | |
| 6,561,279 | B2 | 5/2003 | MacKenzie et al. | |
| 6,578,630 | B2 | 6/2003 | Simpson et al. | |
| 6,619,400 | B2 | 9/2003 | Brunet | |
| 6,732,802 | B2 | 5/2004 | Smith | |

(Continued)

FOREIGN PATENT DOCUMENTS

FR 2692316 12/1993

(Continued)

OTHER PUBLICATIONS

UK Search Report issued for GB Patent Application 0707949.4 on Sep. 28, 2007 (2 pages).

(Continued)

*Primary Examiner*—David J Bagnell
*Assistant Examiner*—Nicole A Coy
(74) *Attorney, Agent, or Firm*—Marlin R. Smith

(57) ABSTRACT

A sealed branch wellbore transition joint. A method of completing a well having intersecting wellbores includes the steps of: positioning a diverter in a wellbore; diverting an assembly from the wellbore into another wellbore; and swelling a sealing material on the assembly, so that a seal is formed between the assembly and the diverter. A completion system for a well having intersecting wellbores includes a diverter positioned in a wellbore, an assembly extending laterally across the wellbore, and a sealing material on the assembly. The sealing material is swollen so that a seal is formed between the assembly and the diverter.

20 Claims, 5 Drawing Sheets

U.S. PATENT DOCUMENTS

| | | | | |
|---|---|---|---|---|
| 6,749,026 | B2 | 6/2004 | Smith et al. | |
| 6,883,611 | B2 | 4/2005 | Smith | |
| 6,994,118 | B2 * | 2/2006 | Kiest et al. | 138/98 |
| 2001/0045284 | A1 | 11/2001 | Simpson et al. | |
| 2002/0157826 | A1 | 10/2002 | MacKenzie et al. | |
| 2003/0173092 | A1 | 9/2003 | Wilson et al. | |
| 2003/0192717 | A1 | 10/2003 | Smith et al. | |
| 2004/0194971 | A1 | 10/2004 | Thomson | |
| 2004/0261990 | A1 * | 12/2004 | Bosma et al. | 166/50 |

FOREIGN PATENT DOCUMENTS

| | | |
|---|---|---|
| GB | 2304764 | 3/1997 |
| GB | 2353811 | 3/2001 |
| GB | 2371579 | 7/2002 |
| GB | 2387614 | 10/2003 |
| GB | 2388136 | 11/2003 |
| GB | 2392178 | 2/2004 |
| GB | 2410515 | 3/2005 |
| GB | 2410515 | 8/2005 |
| RO | 109370 | 1/1995 |
| WO | WO0220941 | 3/2002 |
| WO | WO02059452 | 8/2002 |
| WO | WO03008756 | 1/2003 |
| WO | WO 2005012686 | 2/2005 |

OTHER PUBLICATIONS

Office Action dated Aug. 29, 2006 for U.S. Appl. No. 10/767,656.
Search Report for United Kingdom Application No. GB0308428.2 dated Aug. 18, 2003.
Search Report for United Kingdom Application No. GB0501821.3 dated Mar. 22, 2005.
"HOMCO Internal Steel Liner Casing Patch," Weatherford Fishing and Rental Tool Services, dated 1995.
Sperry-Sun Multilateral Services Profile, "LRS-SL™ Self-Locating Lateral Re-entry System," dated 2000.
Sperry-Sun Multilateral Services Profile, "LRS-SL™ Self-Locating Lateral Re-entry Whipstock," dated 2000.
Sperry-Sun Multilateral Services Profile, "LRS™ Lateral Re-entry System," dated 2000.
Sperry-Sun Multilateral Services Profile, "WREAL™ Wireline Re-entry Alignment System," dated 2000.
Sperry-Sun Multilateral Services Profile, "TEW™ Tubing Exit Whipstock," dated 2000.
Sperry-Sun Multilateral Services Profile, "LRW™ Lateral Re-entry Whipstock," dated 2000.
Sperry-Sun Multilateral Services Profile, "TPI™ Through-Tubing Pressure Isolation Sleeve," dated 2000.
Sperry-Sun Multilateral Services Profile, "Vector Block," dated 2000.
Sperry-Sun Multilateral Services Profile, "RDS™ Re-entry Drilling System," dated 2000.
Sperry-Sun Multilateral Services Profile, "MERLIN™ Milled Exit Retrievable Multilateral System," dated 2000.
Sperry-Sun Multilateral Services Profile, "4502/4503™ Metal Mill-Through Systems," dated 2000.
Sperry-Sun Multilateral Services Profile, "RMLS™ Retrievable Multilateral System," dated 2000.
Sperry-Sun Multilateral Services Profile, "LTBS™ Lateral Tie-Back System," dated 2000.
Sperry-Sun Multilateral Services Profile, "PACE-6™ Pressure-Actuated Casing Exit System," dated 2000.
Sperry-Sun Multilateral Services Profile, "4501™ Low-Side Perforation System," dated 2000.
Sperry-Sun Multilateral Services Profile, "MSCS® Multi-String Completion System," dated 2000.
Sperry-Sun Multilateral Services Profile, "Sperry-Sun Latch Coupling," dated 2000.
Sperry-Sun Multilateral Services Profile, "ITBS™ Isolated Tie-Back System," dated 2000.
Sperry-Sun "Multilateral Products, Services, and Solutions," dated 2000.
Multilateral Technology "MACH-3™ Mechanical Anchored Casing Hanger Level 3 Multilateral System," dated 2003.
Easy Well Solutions, "Swell Packer Datasheet," dated 2003.
IADC/SPE 74496, "A new TAML Level 3 Multilateral System Improves Capabilities and Operational Efficiencies," dated 2002.
Search report for United Kingdom application No. GB 0707832.2, Jul. 6, 2007.

* cited by examiner

SEALED BRANCH WELLBORE TRANSITION JOINT

CROSS-REFERENCE TO RELATED APPLICATION

The present application is a continuation-in-part of U.S. application Ser. No. 10/767,656 filed Jan. 29, 2004 now U.S. Pat. No. 7,213,652. The entire disclosure of this prior application is incorporated herein by this reference.

BACKGROUND

The present invention relates generally to operations performed and equipment utilized in conjunction with a subterranean well and, in an embodiment described herein, more particularly provides a sealed branch wellbore transition joint.

A transition joint is used in completing some multilateral wells, for example, in TAML "Level 3" multilateral completions. As the name implies, the transition joint provides a useful transition between a parent wellbore and a branch wellbore drilled-outwardly from the parent wellbore.

Unfortunately, it is a difficult problem to seal off a formation surrounding the intersection between the parent and branch wellbores from the parent wellbore. Where a sufficient seal is not provided, formation fines and sand can make their way into the parent wellbore, where they can plug or erode production equipment and cause other problems.

Therefore, it may be seen that it would be beneficial to provide improved well completion systems and methods. Such systems and methods could include an improved sealed branch wellbore transition joint.

SUMMARY

In carrying out the principles of the present invention, in accordance with an embodiment thereof, a sealed branch wellbore transition joint is provided for use in well completion systems and methods. A swelling sealing material is preferably used on the transition joint in order to seal off a formation surrounding an intersection between parent and branch wellbores.

In one aspect of the invention, a method of completing a well having intersecting wellbores is provided. The method includes the steps of: positioning a diverter in one of the wellbores; diverting an assembly from the wellbore into another wellbore; and swelling a sealing material on the assembly, so that a seal is formed between the assembly and the diverter.

The sealing material may be used to form other seals in the method, as well. For example, a seal may be formed between the diverter and a wellbore, between the assembly and a window at the intersection of the wellbores, and/or between the assembly and a wellbore. In addition, the assembly may be expanded prior to, after, or during swelling of the sealing material.

In another aspect of the invention, a completion system is provided for a well having intersecting wellbores. The system includes a diverter positioned in one of the wellbores, and an assembly extending laterally across the wellbore. A sealing material on the assembly is swollen so that a seal is formed between the assembly and the diverter.

In a further aspect of the invention, a method of completing a well having a branch wellbore extending outwardly from a window in a parent wellbore is provided. The method includes the steps of: positioning an assembly in the window; and swelling a sealing material on the assembly. A seal is formed between the assembly and the window by the swelling sealing material.

In a still further aspect of the invention, a completion system for a well having a branch wellbore extending outwardly from a window in a parent wellbore is provided. The system includes a tubular string having a portion positioned within the window, and a sealing material on the tubular string portion. The sealing material swells in the well to thereby form a seal between the tubular string portion and the window.

In yet another aspect of the invention, a completion system for a well having a branch wellbore extending outwardly from a window in a parent wellbore includes an assembly positioned in the parent wellbore, the assembly having an opening formed through a sidewall thereof. The opening is aligned with the window. A sealing material is positioned on the assembly. The sealing material swells in the well to thereby form a seal circumferentially about the opening.

In a further aspect of the invention, a method of completing a well having a branch wellbore extending outwardly from a window in a parent wellbore includes the steps of: positioning an assembly in the parent wellbore; forming an opening through a sidewall of the assembly; aligning the assembly with the window; and swelling a sealing material on the assembly, so that a seal is formed about the opening.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
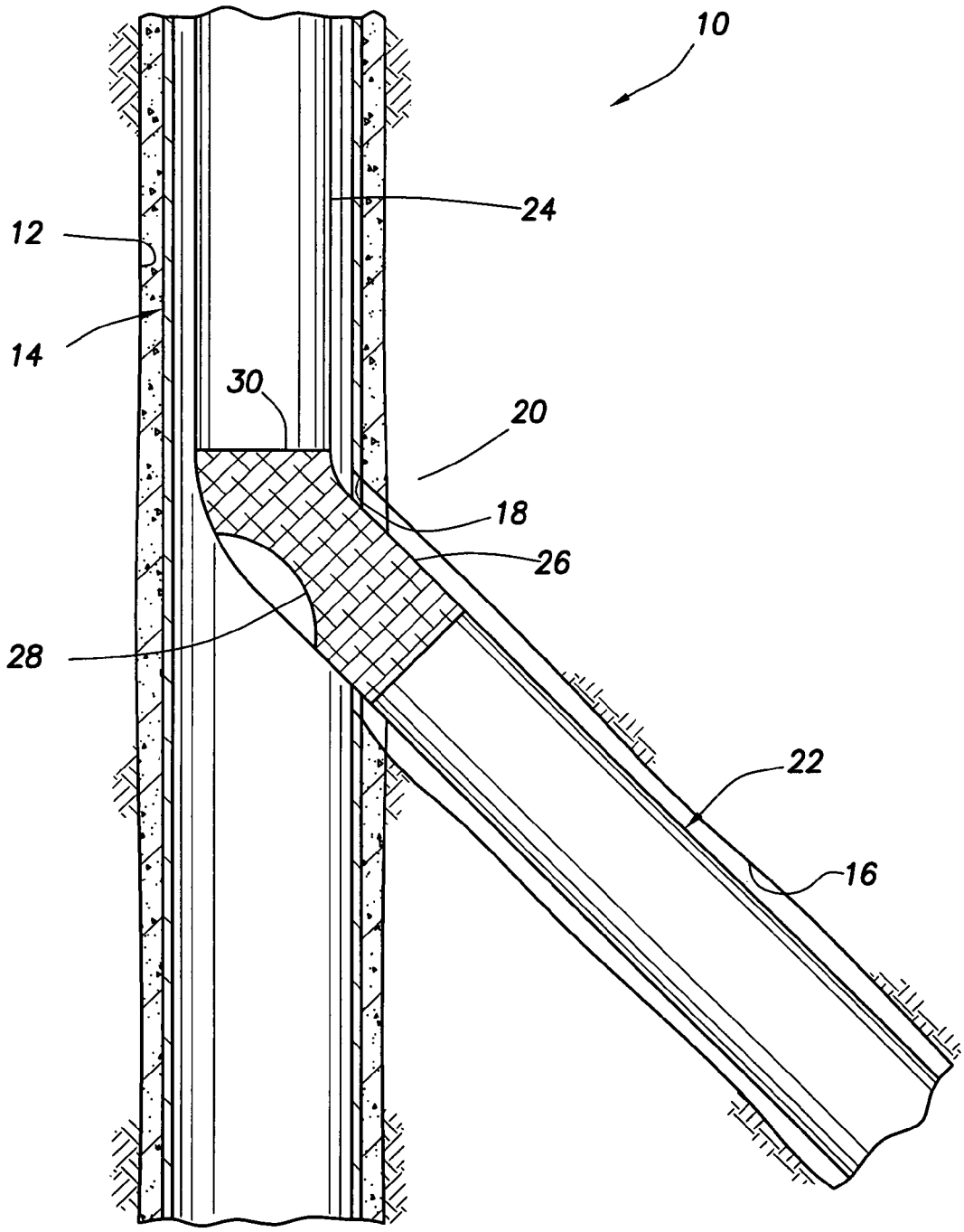
FIG. 1 is a schematic partially cross-sectional view of a first well completion system embodying principles of the present invention.

As depicted in FIG. 1, a main or parent wellbore 12 has been drilled, and then lined with protective casing 14. The parent wellbore 12 may extend continuously to the earth's surface, or it may be a branch of another wellbore. It is not necessary in keeping with the principles of the invention for the parent wellbore 12 to be cased, since it could be completed open hole if desired. If the parent wellbore 12 is cased, then the wellbore can be considered the interior of the casing 14.

A branch wellbore 16 is drilled extending outwardly from a window 18 formed through a sidewall of the casing 14. The window 18 can be formed before or after the casing 14 is installed in the parent wellbore 12. For example, the window 18 could be formed by anchoring a whipstock (not shown in FIG. 1, see FIG. 5) in the casing 14, and then deflecting a mill laterally off of the whipstock to cut the window through the casing sidewall.

A formation or zone 20 surrounds the intersection between the parent and branch wellbores 12, 16. In order to seal off the formation 20 from the interior of the parent wellbore 12, while also providing a useful transition between the parent and branch wellbores 12, 16, an assembly 22 is positioned in the window 18. The assembly 22 is depicted in FIG. 1 as including a tubular string 24 having a transition joint 26 interconnected therein.

A lower end of the tubular string 24 is deflected into the branch wellbore 16, for example, by using the whipstock or other deflector positioned in the parent wellbore 12. The tubular string 24 could be cemented in the branch wellbore 16, if desired.

The transition joint 26 has an opening 28 formed through a sidewall thereof. The opening 28 may be formed in the sidewall of the transition joint 26 before or after the transition joint is installed in the well. The opening 28 provides fluid communication (and preferably access) between an interior of the tubular string 24 and the parent wellbore 12 external to the tubular string below the window 18.

A sealing material 30 is provided on the transition joint 26. Preferably, the sealing material 30 is provided in the form of a coating adhered externally to the transition joint 26. However, other methods of attaching the sealing material 30 to the transition joint 26 may be used in keeping with the principles of the invention.

The sealing material 30 swells when exposed to fluid in the well. Preferably, the sealing material 30 increases in volume and expands radially outward when a particular fluid contacts the sealing material in the well. For example, the sealing material 30 could swell in response to exposure to hydrocarbon fluid (such as oil or gas), or in response to exposure to water in the well.

The sealing material 30 could be made of a specialized rubber compound, or it could be made of other materials. Acceptable materials for the sealing material 30 are available from Easywell A. S. of Stavanger, Norway.

Figure 2:
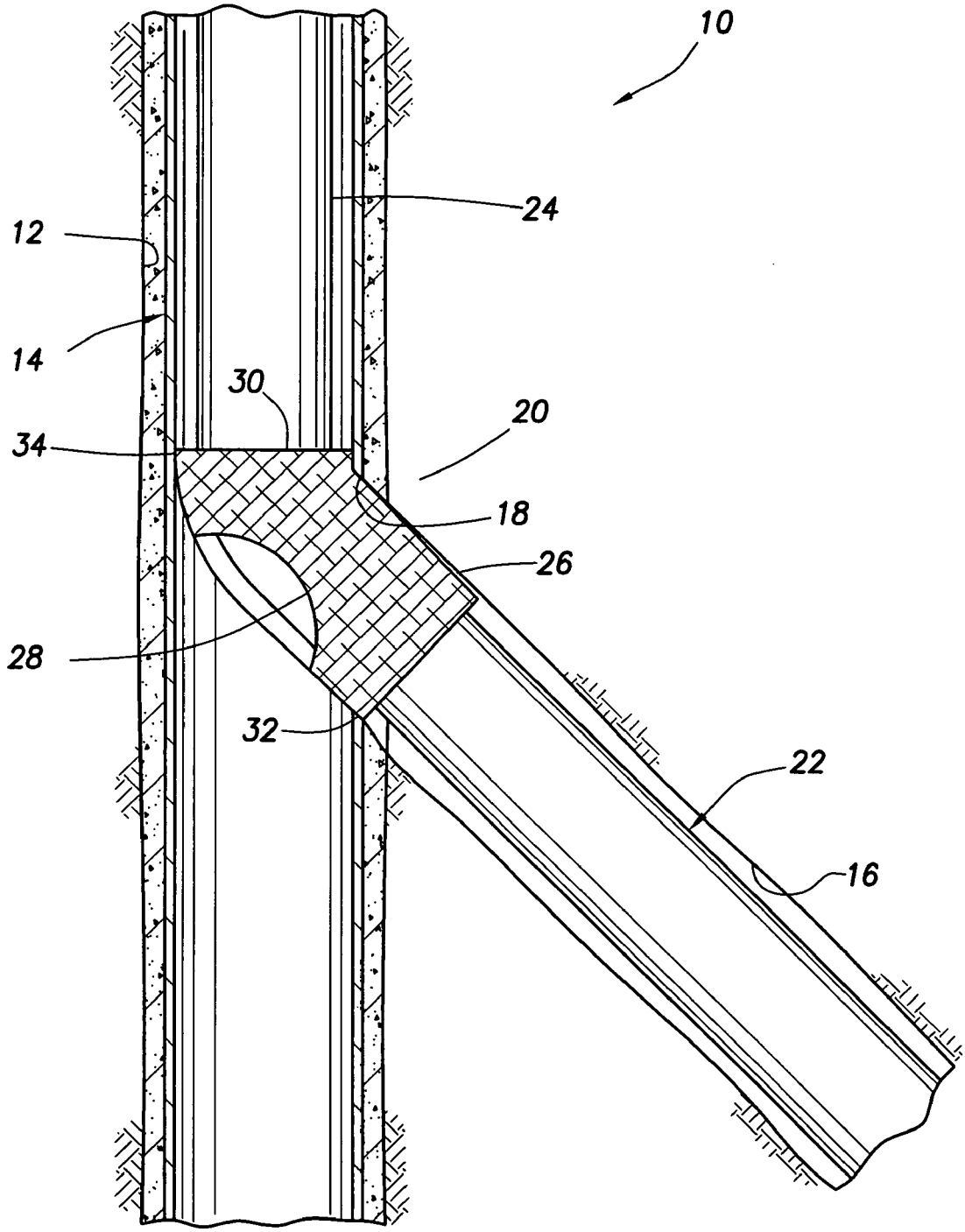
FIG. 2 is a schematic partially cross-sectional view of the first system, wherein a branch wellbore transition joint has been sealed.

Referring additionally now to FIG. 2, the system 10 is depicted after the sealing material 30 has swollen in the window 18. Note that a seal 32 is now formed by the swollen sealing material 30 between the transition joint 26 and the window 18. This seal 32 may be used to prevent fines, sand, etc. from migrating from the formation 20 into the parent wellbore 12. The tubular string 24 could be cemented in the branch wellbore 16 before or after the seal 32 is formed.

In addition, the swollen sealing material 30 can (but does not necessarily) provide another seal 34 between the transition joint 26 and the casing 14 in the parent wellbore 12. This seal 34 can be used as an annular barrier above the opening 28. Note that the opening 28 is conveniently positioned between the seals 32, 34 for providing fluid communication between the interior of the tubular string 24 and the parent wellbore 12 below the window 18.

Figure 3:
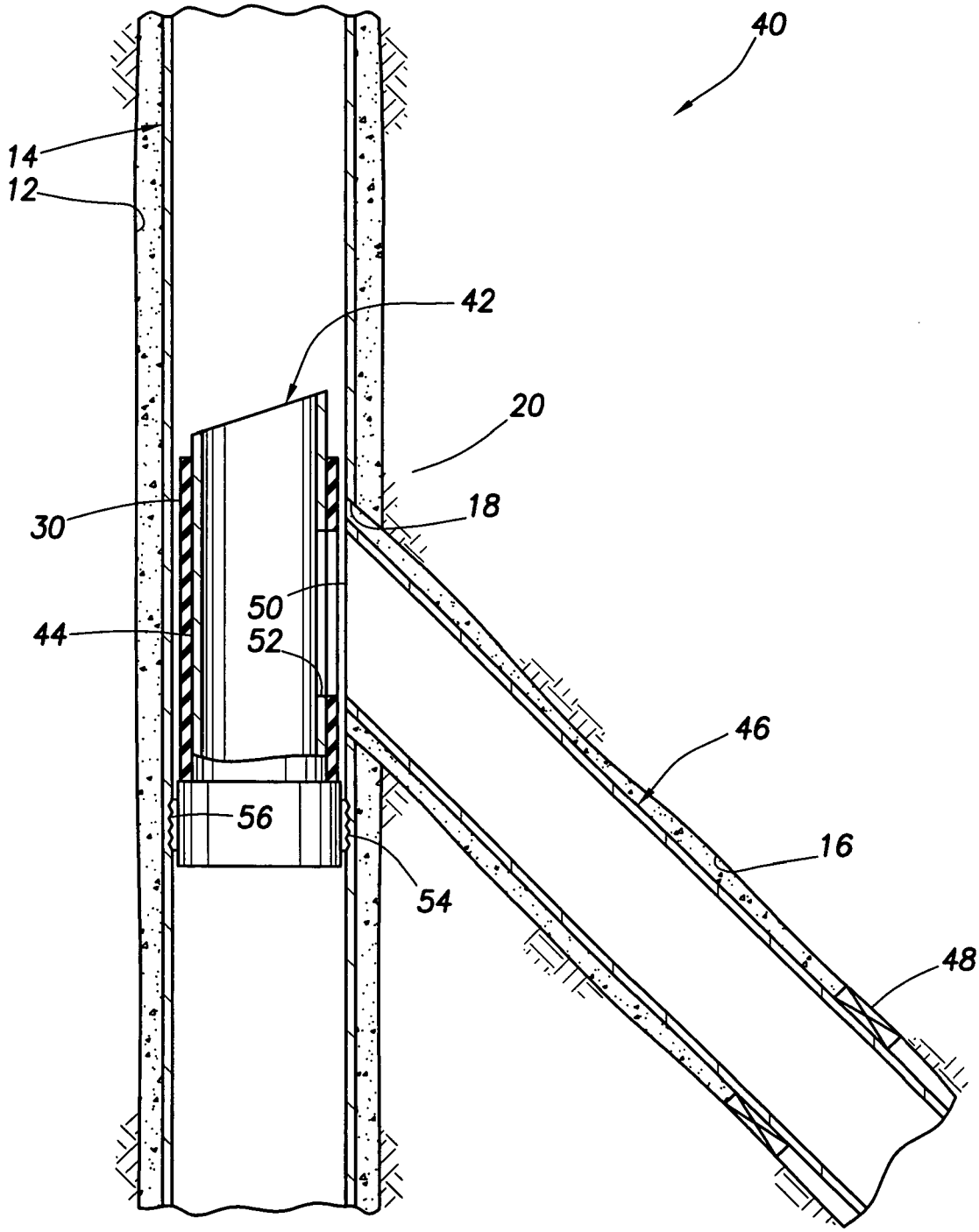
FIG. 3 is a schematic partially cross-sectional view of a second well completion system embodying principles of the present invention.

Referring additionally now to FIG. 3, another completion system 40 embodying principles of the invention is representatively illustrated. The system 40 is similar in many respects to the system 10 described above, and so elements of the system 40 which are similar to those described above are indicated in FIG. 3 using the same reference numbers.

The system 40 differs from the system 10 in at least one significant respect in that, instead of positioning the tubular string 24 in the parent and branch wellbores 12, 16, an assembly 42 is positioned in the parent wellbore opposite the window 18. The assembly 42 includes a tubular structure 44 having the sealing material 30 externally secured thereto. In addition, a tubular string 46, such as a liner string, is positioned in the branch wellbore 16.

The tubular string 46 is preferably positioned in the branch wellbore 16 prior to positioning the assembly 42 in the parent wellbore 12. The tubular string 46 may be cemented in the branch wellbore 16, for example, between the window 18 and a packer 48 set in the branch wellbore, or the tubular string may be otherwise cemented or left uncemented in the branch wellbore. An upper end 50 of the tubular string 46 may extend to the parent wellbore 12, where it may be cut off, such as by use of a washover tool, etc.

When the assembly 42 is positioned in the parent wellbore 12, it may have an opening 52 formed through its sidewall. This opening 52 may be rotationally aligned with the window 18 by engagement between a latch 54 of the assembly 42 and an orienting profile 56 of the casing string 14. This engagement may also anchor the assembly 42 in the casing string 14.

Alternatively, the opening 52 could be formed after the assembly 42 has been positioned in the parent wellbore 12. For example, a deflector (such as a whipstock) could be secured in the assembly 42 and used to deflect a cutting tool (such as a mill) to form the opening 52 through the assembly sidewall after the assembly is anchored in the casing string 14. Furthermore, the opening 52 could be formed through the sidewall of the assembly 42 after the sealing material 30 has swelled.

Figure 4:
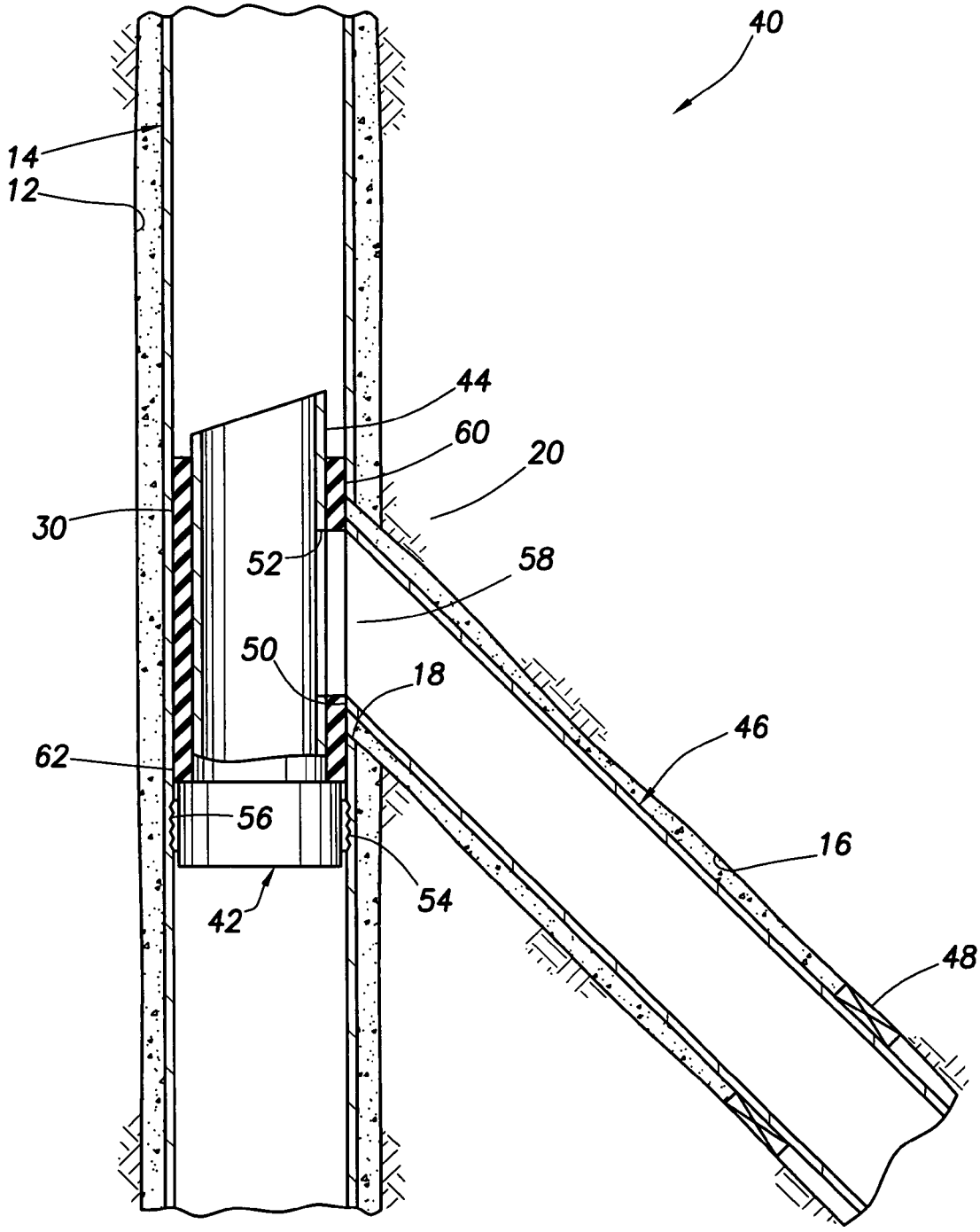
FIG. 4 is a schematic partially cross-sectional view of the second system, wherein an intersection between wellbores has been sealed.

Referring additionally now to FIG. 4, the system 40 is representatively illustrated after the sealing material 30 has swelled. The sealing material 30 may be swollen by exposure to fluid in the well, such as hydrocarbon fluid or water, etc. A volume of the sealing material 30 increases as it swells.

A sealed flowpath 58 is now provided between the branch wellbore 16 and the parent wellbore 12 through an interior of the assembly 42. This flowpath 58 is isolated from the formation 20 surrounding the intersection between the parent and branch wellbores 12, 16.

Specifically, the sealing material 30 now forms a seal 60 between the assembly 42 and the interior of the casing string 14 circumferentially about the opening 52 and circumferentially about the window 18. The sealing material 30 also preferably sealingly engages the upper end 50 of the tubular string 46 and seals circumferentially thereabout. In addition, the swollen sealing material 30 forms an annular seal 62 between the tubular structure 44 and the interior of the casing string 14 both above and below the window 18.

Figure 5:
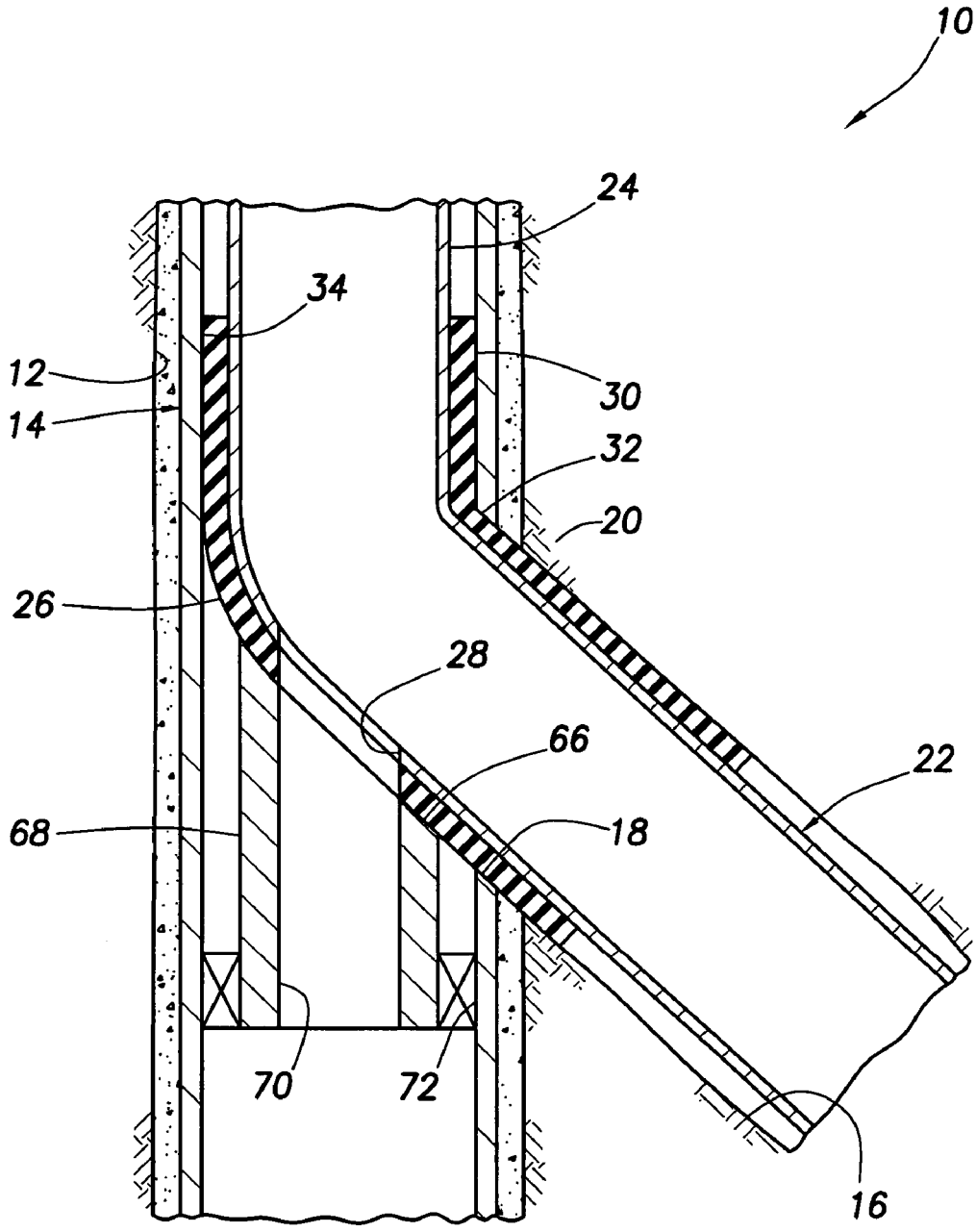
FIG. 5 is a somewhat enlarged scale schematic cross-sectional view of an alternate configuration of the first system.

Referring additionally now to FIG. 5, the system 10 is representatively illustrated in an alternate configuration. In this alternate configuration, the sealing material 30 forms a seal 66 at an upper end of a diverter 68 positioned in the parent wellbore 12.

As described above, the diverter 68 could be used in forming the window 18 and/or in deflecting the lower end of the assembly 22 into the branch wellbore 16 from the parent wellbore 12. Thus, the diverter 68 could be of the type known to those skilled in the art as a drilling whipstock, completions diverter, or another type of diverter.

Note that the diverter 68 has a passage 70 formed completely longitudinally through the diverter. In this manner, the passage 70 permits flow communication and access between the parent wellbore 12 above and below the window 18.

As with the system 10 as depicted in FIGS. 1 & 2, the opening 28 may be formed prior to or after installing the assembly 22. Any method may be used for forming the opening 28, including but not limited to milling, perforating (e.g., prior to or instead of milling), chemical cutting, etc.

The seal 66 is formed at the top of the diverter 68 and extends circumferentially about the passage 70, so that sealed communication is provided between the passage and the interior of the assembly 22. This seal 66 may serve as a backup to the seal 32, in order to prevent sand, fines, debris, etc. from entering the parent wellbore 12 from the formation 20 and the wellbore junction, or the seal 66 could be used in place of the seal 32. In the latter case, use of the seal 66 may eliminate any need to seal against the window 18, which may have an irregular interior surface that could be difficult to seal against.

In some situations, it may be desired to flow cement or another hardenable sealing substance into the wellbore junction area to seal about the tubular string 24. In that case, the seal 66 may be used to prevent the cement or other substance from flowing into the passage 70 and remainder of the parent wellbore 12.

The sealing material 30 could also be used on the diverter 68 to form a seal 72 between the diverter and the interior of the casing string 14. For example, the diverter 68 could be provided with a latch and orienting profile (similar to the latch 54 and orienting profile 56 described above) to orient and anchor the diverter in the casing string 14, and the sealing material 30 could swell to seal between the diverter and the interior of the casing string (similar to the manner in which the sealing material seals between the tubular structure 44 and the interior of the casing string as depicted in FIG. 4).

In the configuration of the system 10 depicted in FIG. 5, the tubular string 24 is preferably expanded radially outward after being positioned at the wellbore junction with its lower end in the branch wellbore 16. In this manner, clearance between the tubular string 24 and the window 18, casing string 14 and upper end of the diverter 68 can be reduced. This reduced clearance will enhance the formation and maintenance of the seals 32, 34, 66.

Various methods may be used to expand the tubular string 24. For example, a swage, drift, rollers, etc. may be used to mechanically deform the tubular string 24 radially outward. As another example, increased pressure may be applied internally to the tubular string 24 to inflate it. Any method of expanding the tubular string 24 may be used in keeping with the principles of the invention.

Swelling of the sealing material 30 may be initiated before, during and/or after the expansion of the tubular string 24. Preferably, the swelling is initiated after the clearance between the tubular string 24 and the structure(s) (casing string 14, window 18 and/or diverter 68) against which the sealing material 30 will seal has been reduced.

Note that this expansion process may be used in the system 10 depicted in FIGS. 1 & 2 and described above, and may also be used in the system 40 depicted in FIGS. 3 & 4 and described above. Thus, the tubular string 24 could be expanded in the system 10 of FIGS. 1 & 2, and the tubular structure 44 could be expanded in the system 40 of FIGS. 3 & 4.

In addition, although the systems 10, 40 have been described above as including the seals 32, 34, 60, 62, 66, it should be clearly understood that it is not necessary for the respective systems to include all or any particular combination of these seals. Any one, and any combination of, the seals 32, 34, 60, 62, 66, and any other seals may be provided in the systems 10, 40 in keeping with the principles of the invention.

Furthermore, although the sealing material 30 has been depicted in the drawings as being a single element, it will be readily appreciated that the sealing material could be formed in multiple separate elements, if desired. For example, any of the seals 32, 34, 60, 62, 66, and any combination of these, could be formed by separate portions of the sealing material 30.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A method of completing a well having first and second intersecting wellbores, the method comprising the steps of:

positioning a diverter in the first wellbore;

diverting an assembly from the first wellbore into the second wellbore; and swelling a sealing material on the assembly, so that a first seal is formed between the assembly and the diverter.

2. The method of claim 1, wherein the swelling step further comprises increasing a volume of the sealing material.

3. The method of claim 1, wherein the diverting step further comprises positioning the assembly at least partially in the first wellbore and at least partially in the second wellbore.

4. The method of claim 1, further comprising the step of expanding the assembly.

5. The method of claim 1, wherein the expanding step is performed prior to the swelling step.

6. The method of claim 1, further comprising the step of providing fluid communication between an interior of the assembly and the first wellbore via an opening formed through a sidewall of the assembly.

7. The method of claim 1, wherein the swelling step further comprises forming a second seal between the assembly and the first wellbore.

8. The method of claim 1, wherein the swelling step further comprises forming a second seal between the assembly and a window from the first wellbore to the second wellbore.

9. The method of claim 1, further comprising the step of swelling a second seal between the diverter and the first wellbore.

10. The method of claim 1, wherein the swelling step further comprises swelling the sealing material in response to exposing the sealing material to hydrocarbon fluid in the well.

11. The method of claim 1, wherein the swelling step further comprises swelling the sealing material in response to exposing the sealing material to water in the well.

12. A completion system for a well having intersecting first and second wellbores, the system comprising:

a diverter positioned in the first wellbore;

an assembly extending laterally across the first wellbore; and a sealing material on the assembly, the sealing material being swollen so that a first seal is formed between the assembly and the diverter.

13. The system of claim 12, wherein the sealing material is swollen by increasing a volume of the sealing material.

14. The system of claim 12, wherein the assembly is positioned at least partially in the first wellbore and at least partially in the second wellbore.

15. The system of claim 12, wherein the assembly is expanded radially outward in the well.

16. The system of claim 12, wherein an opening provides fluid communication between an interior of the assembly and the first wellbore through a sidewall of the assembly.

17. The system of claim 12, further comprising a second seal formed by the swollen sealing material between the assembly and the first wellbore.

18. The system of claim 12, further comprising a second seal formed by the swollen sealing material between the assembly and a window from the first wellbore to the second wellbore.

19. The system of claim 12, further comprising a second seal formed by the swollen sealing material between the diverter and the first wellbore.

20. The system of claim 12, wherein the sealing material is swollen in response to exposing the sealing material to at least one of hydrocarbon fluid and water in the well.

* * * * *